US007185892B2

(12) United States Patent
Moberg

(10) Patent No.: US 7,185,892 B2
(45) Date of Patent: Mar. 6, 2007

(54) APPARATUS FOR SHOOTING RANGES

(76) Inventor: Gerth Moberg, P.O. Box Helgenas, 590 98 Edsbruk (SE)

( * ) Notice: Subject to any disclaimer, the term of this patent is extended or adjusted under 35 U.S.C. 154(b) by 0 days.

(21) Appl. No.: 10/542,270

(22) PCT Filed: Dec. 29, 2003

(86) PCT No.: PCT/SE03/02096

§ 371 (c)(1),
(2), (4) Date: Jul. 14, 2005

(87) PCT Pub. No.: WO2004/065887

PCT Pub. Date: Aug. 5, 2004

(65) Prior Publication Data

US 2006/0131813 A1 Jun. 22, 2006

Related U.S. Application Data

(60) Provisional application No. 60/319,882, filed on Jan. 20, 2003.

(51) Int. Cl.
*F41J 1/12* (2006.01)

(52) U.S. Cl. ..... 273/410

(58) Field of Classification Search ..... 273/404–410
See application file for complete search history.

(56) References Cited

U.S. PATENT DOCUMENTS

| | | | | |
|---|---|---|---|---|
| 5,799,948 | A * | 9/1998 | Moberg | 273/410 |
| 6,000,700 | A * | 12/1999 | Nesler et al. | 273/410 |
| 6,173,956 | B1 * | 1/2001 | O'Neal | 273/410 |
| 6,715,761 | B1 * | 4/2004 | Moberg | 273/410 |
| 2004/0104533 | A1 * | 6/2004 | Larson et al. | 273/404 |

FOREIGN PATENT DOCUMENTS

GB 2242730 A * 10/1991

* cited by examiner

*Primary Examiner*—Mark S. Graham
(74) *Attorney, Agent, or Firm*—Fasth Law Offices; Rolf Fasth

(57) ABSTRACT

The apparatus is for installation at shooting ranges and has a housing that has a resilient top layer and a flexible bottom layer. The bottom layer extends along an inclined bottom surface and over an upwardly protruding support member to a front side. The top layer is attached to the bottom layer at the front side to form a container. A non-flowable granulate material is packed in the container. The inclined bottom surface is inclined at an angle relative to a horizontal plane. The angle is less than an angle of repose of the granulated material.

11 Claims, 8 Drawing Sheets

FIG. 7
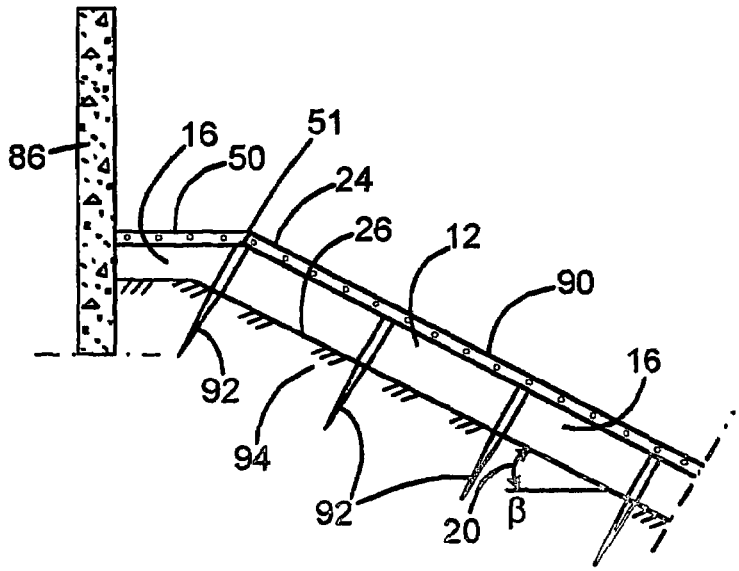
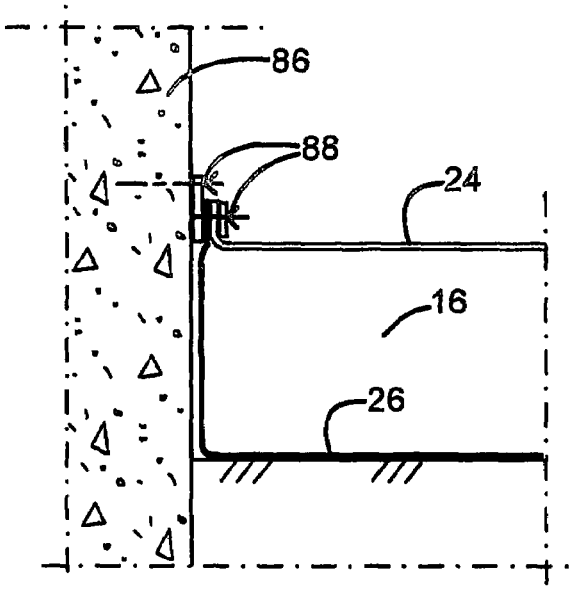
FIG. 8
FIG. 9
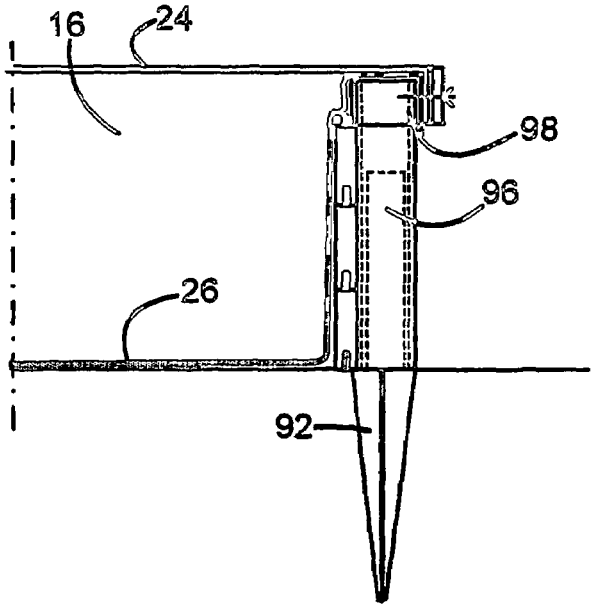

APPARATUS FOR SHOOTING RANGES

PRIOR APPLICATION

This application is a U.S. national phase application based on International Application No. PCT/SE2003/002096, filed 29 Dec. 2003, claiming priority from U.S. Provisional Patent Application Ser. No. 60/319,882, filed 20 Jan. 2003.

TECHNICAL FIELD

The present invention relates to an apparatus for installation at shooting ranges and has a non-flowable granulate material that is used as a stopping material for projectiles.

BACKGROUND OF INVENTION

Most bullets and other projectiles are fully or partly made of lead or other contaminating materials. This leads to an environmental problem at shooting ranges when the bullets are captured by sandbanks and other inclined surfaces positioned behind the targets. Large amounts of lead and lead compounds leach into the ground in an uncontrolled manner. There is a need for an apparatus that effectively and safely captures lead and other bullets without polluting the environment.

SUMMARY OF INVENTION

The present invention provides a solution to the above-outlined problems. More particularly, the apparatus of the present invention is for installation at shooting ranges. The apparatus has a housing that has a resilient top layer and a flexible bottom layer. The layer extends along an inclined bottom surface and over an upwardly protruding support member to a front side. The top layer is attached to the bottom layer at the front side to form a container. A non-flowable granulate material is packed in the container. The inclined bottom surface is inclined at an angle relative to a horizontal plane. The angle is less than an angle of repose of the granulated material.

BRIEF DESCRIPTION OF DRAWINGS

FIG. 7 is a detailed cross-sectional view of an upper segment of the lower housing;

FIG. 8 is a detailed cross-sectional view of an attachment segment of FIG. 7;

FIG. 9 is a detailed cross-sectional view of a portion of a sidewall shown in FIG. 8;

DETAILED DESCRIPTION

Figure 1:
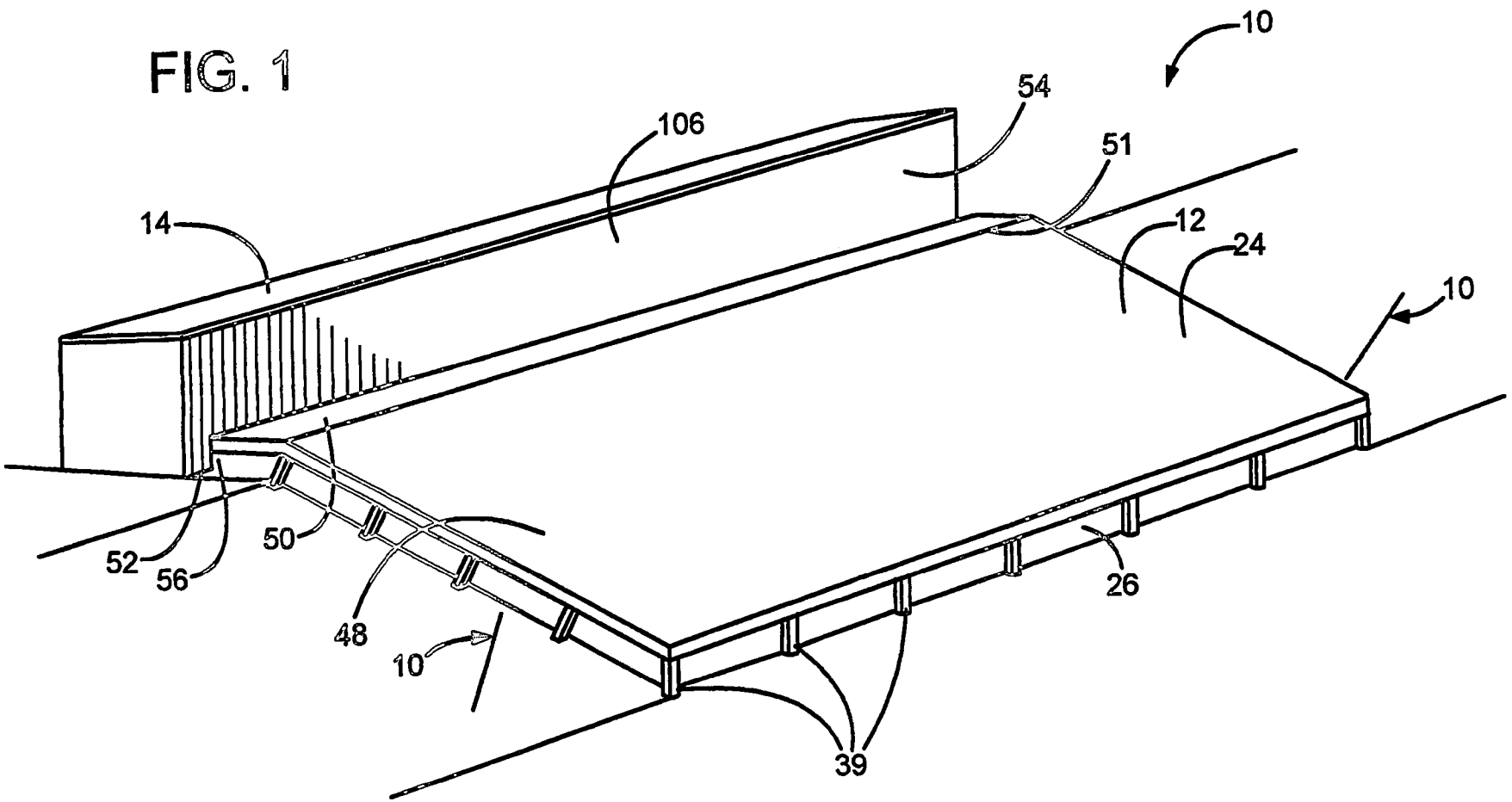
FIG. 1 is a perspective view of the apparatus of the present invention.
Figure 2:
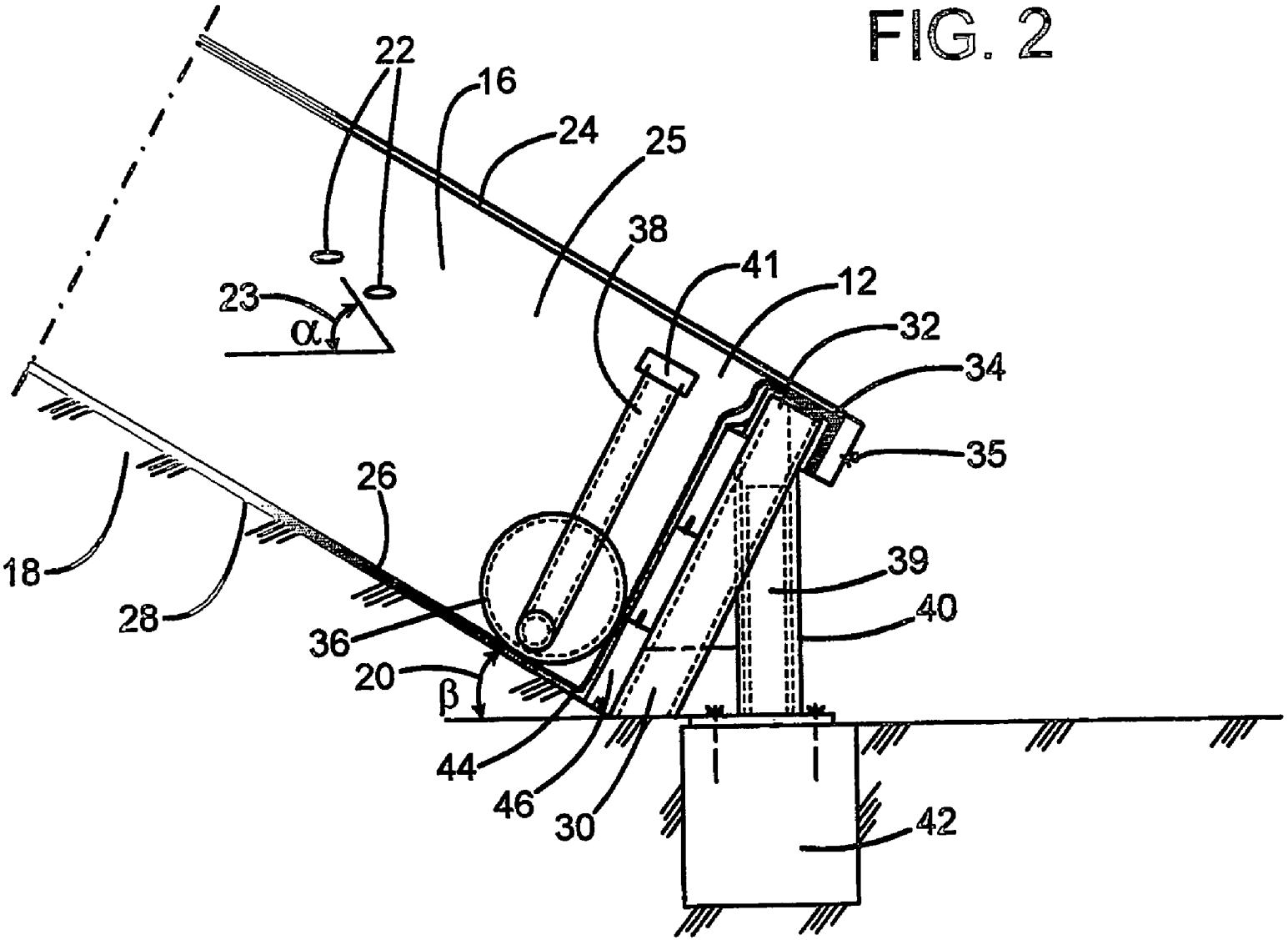
FIG. 2 is a detailed cross-sectional view of the lower housing.

With reference to FIGS. 1–2, the shooting range apparatus 10 of the present invention has a lower watertight sloping bullet catcher housing 12 and an upper bullet catcher housing 14 that may be spaced, by for example a 30 centimeters gap 52, from the housing 12. The housing 12 includes a non-flowable granulate material 16 that is packed in the housing 12. The housing 12 may be placed on a bottom surface 28 of a sloping ground segment 18 at an angle 20 that, preferably, is less an angle of repose 23 of the granulate 16 and same as the housing 12. The angle 20 may be about 30 degrees or any other suitable angle. The angle of repose may mean the equilibrium angle of the granulated material 16 at which the granulate material 16 may start to flow due to the gravitational forces overtaking the frictional forces between the granulate particles and the frictional forces between the granulate material and the supporting surface. In other words, the angle of repose may be the angle from the horizontal that the granulated material 6 assumes when at rest, from the top of the pile to its base. The angle of repose may be greater than the angle of slide that may mean the angle to the horizontal at which the granulate material 16 will begin to slide on a smooth, flat surface, by its own weight.

An important feature of the present invention is that the granulated material 16 may be tightly packed in the housing 12. The granulated material 16 may include a stationary non-flowable rubber material that is tightly enclosed in the housing 12 to prevent lead pollution from lead bullets and other projectiles 22. Because the rubber material 16 is non-flowable, the rubber material 16 retains the projectiles 22 that penetrate into the rubber material 16 and the projectiles 22 may adhere to and become part of the rubber material 16 since the rubber material 16 is not free-flowable and the sloping angle of the support surface is below the angle of repose of the granulate material 16.

The housing 12 has a resilient top layer 24 and a bendable bottom rubber layer 26. The top layer 24 may extend across the entire housing 12 and be made of a material that permits the penetration of the projectiles 22 while preventing any granulate material 16 from escaping the housing 12.

The bottom layer 26 rests on the inclined bottom surface 28 and extends up over a supporting segment 30 and over an upside down U-shaped member 32. The supporting segment 30 car be any supporting member or wall made of wood, sand, stone, bags or any other suitable supporting material. Preferably, the bottom layer 26 is watertight but it does not have to be as long as the layer 26 separates the granulated material 16 from the ground or support surface. The layer 26 and the top layer 24 may together be tightly attached to a front side 34 of the member 32 with a fastener 35 that may extend along the entire width W of the housing 12. In this way, the layer 24 and the layer 26 may form watertight container 25. A gap 46 may be formed between the layer 26 and the supporting segment 30. The gap may be defined by a polyethylene member that supports the granulate material.

Adjacent to a corner 44 between the bottom surface 28 and the segment 30 is a drainage pipe 36 located. The pipe 36, that may extend along the entire width W of the housing 12, is, at one end of the pipe, in fluid communication with an outlet tube 38 that has a lid 41. The lid 41 may be opened for withdrawing or pumping any water and pollutants that may have gathered in the drainage pipe 36. It may also be possible to associate the pipe 36 to an outlet for a safe and automatic drainage of the pollutants.

A vertical steel tube 39 that has a plastic skin 40 extends from a concrete slab 42 into the U-shaped member 32 and provides support for the members 30, 32. The slab 42 may extend along an entire width W of the housing 12 and the slap 42 supports a plurality of tubes 39 that are spaced apart about 120 centimeters from one another. The U-shaped member 32 may also extend along the entire width W of the housing 12. Instead of using concrete slab, it is possible to use anchors or any other suitable technology.

As best shown in FIG. 1, the housing 12 has a sloping segment 48 and a substantially horizontal segment 50 extending towards a front part or wall 54 of the top housing 14. Preferably, the gap 52 is formed between a front wall 54 of the housing 14 and the backend 56 of the horizontal segment 50. It is possible to add another sloping housing behind the housing 14 that is similar to the housing 12.

Figure 3:
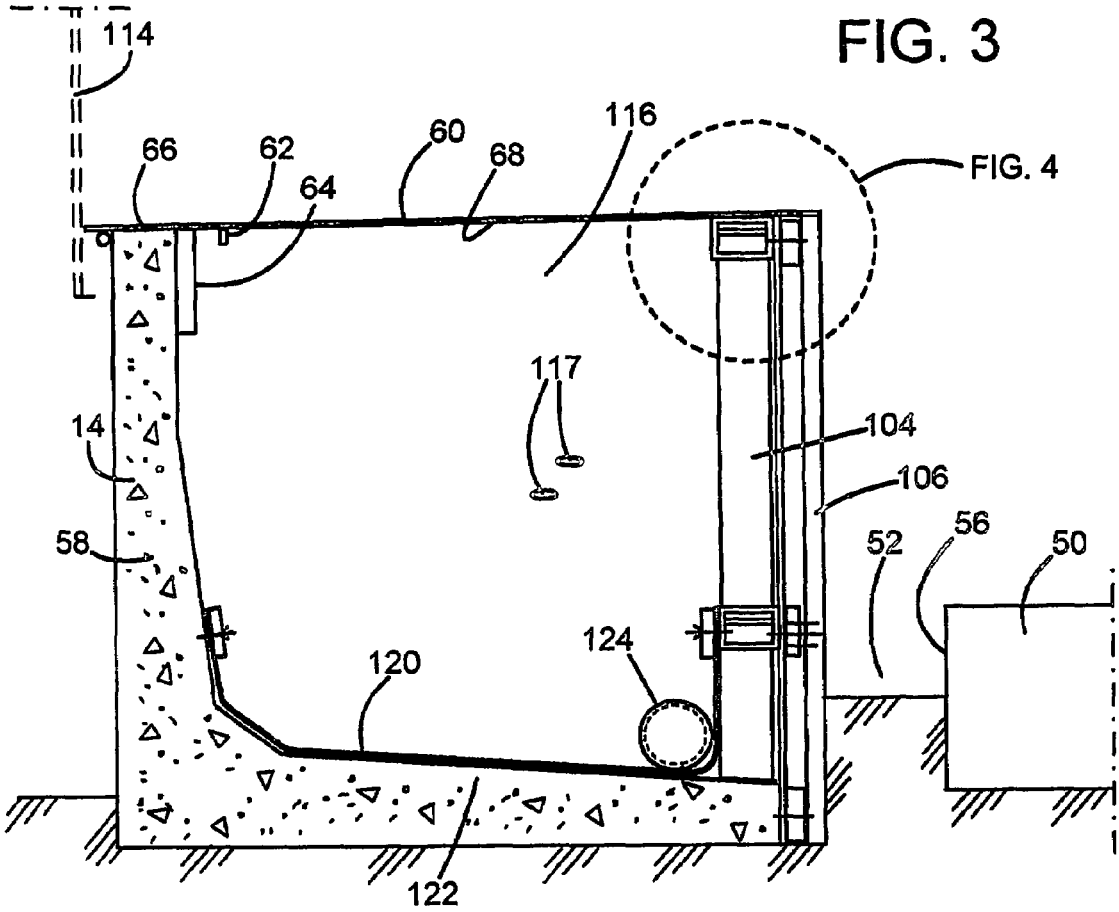
FIG. 3 is a detailed cross-sectional view of the upper housing.

FIG. 3 shows a detailed cross sectional view of the housing 14. The housing 14 has an L-shaped concrete slab 58 and a lid 60 that are in operative engagement with the front wall 54. Vertical protecting plates 62 and 64 extend downwardly from the lid 60 to prevent projectiles from penetrating between the top surface 66 of the slab 58 and the bottom surface 68 of the lid 60. Preferably, the plate 64 is longer than the plate 62. The plate 64 also has a protective function, should the level of the granulate 116 be lowered over time so that a gap is created between the top surface of the granulate material and the lid 60. The plate 64 prevents projectiles from destroying the L-shaped box. A watertight layer 120 is disposed along a floor section 122 of the concrete 58. Similar to the housing 12, a drainage pipe 124 may be disposed at the lowest point of the housing 14.

Figure 4:
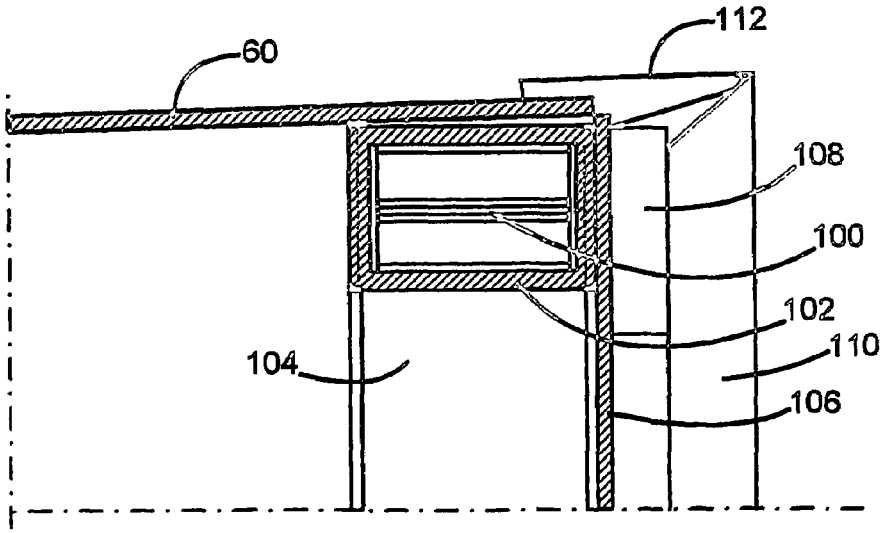
FIG. 4 is a detailed cross-sectional view of an upper corner of the upper housing.

FIG. 4 is a detailed view of FIG. 3 and shows a horizontal steel bar 100 surrounded by a plastic pipe 102 that rests on a vertical steel bar 104. The steel bar 100 may extend along the entire width W while the bars 104 may be separated by a distance of about 1.5 meters between each vertical bar 104. The housing 12 has a resilient rubber front layer 106 that permits projectiles to pass there through and a plastic profile 108 is placed adjacent to the pipe 102 and plastic profiles 110 are in operative engagement with the front layer 106 of the front wall 54. A wedge 112 is placed on top of the profile 108 to guide projectiles into the granulated material 116 of the housing 14. Projectiles that travel above the wedge 112 may hit the targets 114.

Figure 5:
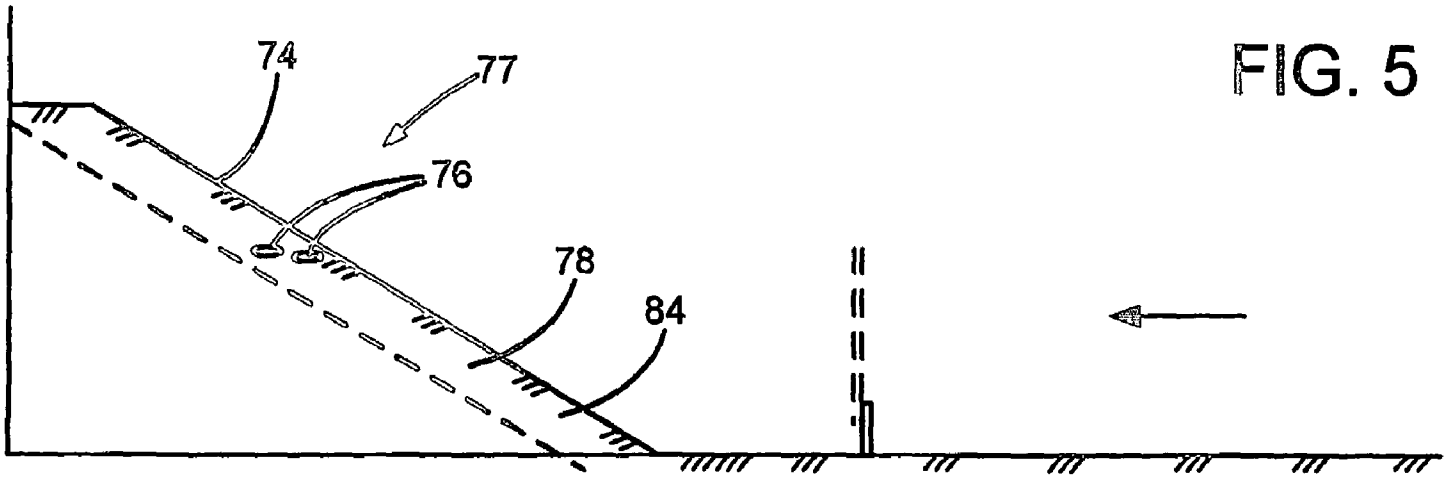
FIG. 5 is a schematic side view of a contaminated sandbank.
Figure 6:
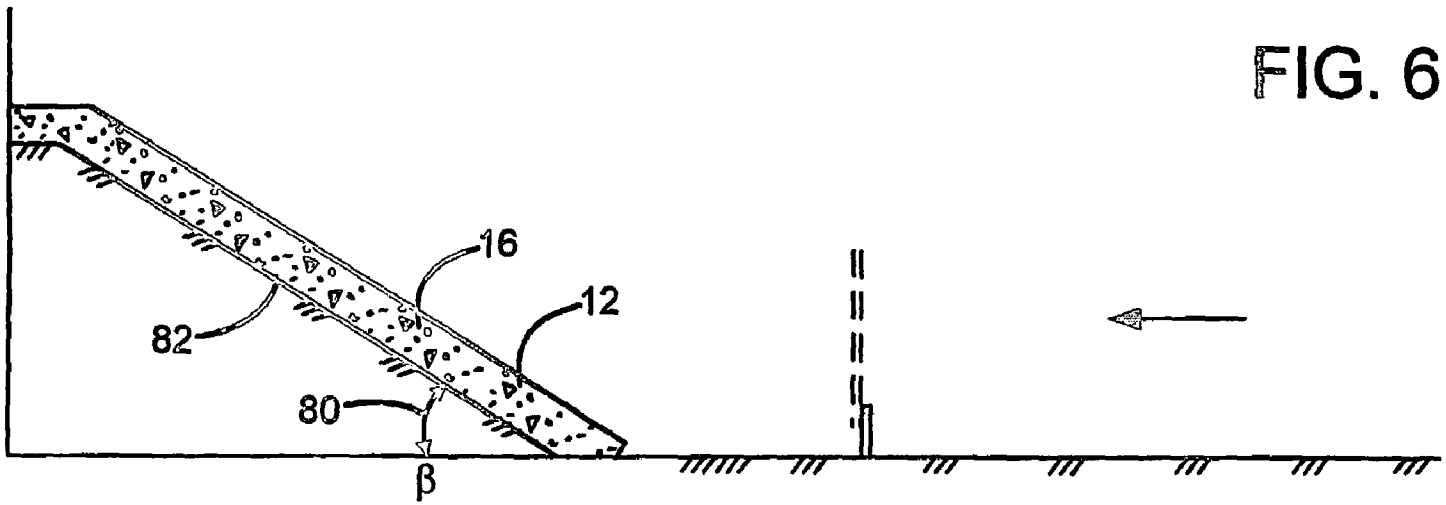
FIG. 6 is a side view of the lower housing placed or the sandbank shown in FIG. 5.

FIG. 5 shows the trap assembly used for retrofitting a contaminated shooting range 77. A sloping sandbank 74 is contaminated with projectiles 76. Usually a section 78 that is about 0.5–0.6 meters deep is contaminated and is removed. As best shown in FIG. 6, the housing 12 may be used to replace the section 78 to prevent future lead contamination. Preferably, the angle 80 is below the angle of repose of the granulated material 16 disposed inside the housing 12. The granulated material 16 often has an angle of repose that is steeper than the sand 84 of the sandbank so if the angle of repose of the sand is used this angle is less than the angle of repose of the granulated material 16. In general, there is more friction between the granulate particles compared to the friction between the sand particles. A sloping sand surface 82 is thus used to support the housing 12.

FIG. 7 is a cross-sectional view of the housing 12 bearing against a vertical concrete wall segment 86. The housing 12 has a side wall segment 90 with anchors 92. The housing 12 has the horizontal segment 50 that is used to catch projectiles that penetrate the top layer 24 at the upper end 51 of the housing 12. The segment 50 is also filled with granulate 16.

FIG. 8 is a detailed view of FIG. 7. The top layer 24 and the bottom layer 26 and tightly joined and attached to the wall segment 86 by steel fastener assemblies 88. As best shown in FIG. 7, the layer 26 rests upon the sloping sand or filling material 94 that has the angle 20 below the angle of repose of the granulate 16, as indicated above. FIG. 9 is a detailed view of FIG. 7 and shows a support member 96 and an upside down U-shaped member 98. The top layer 24 and the bottom layer 26 are tightly joined in front of the member 98 similar to the attachment to U-shaped member 34 described above.

Figure 10:
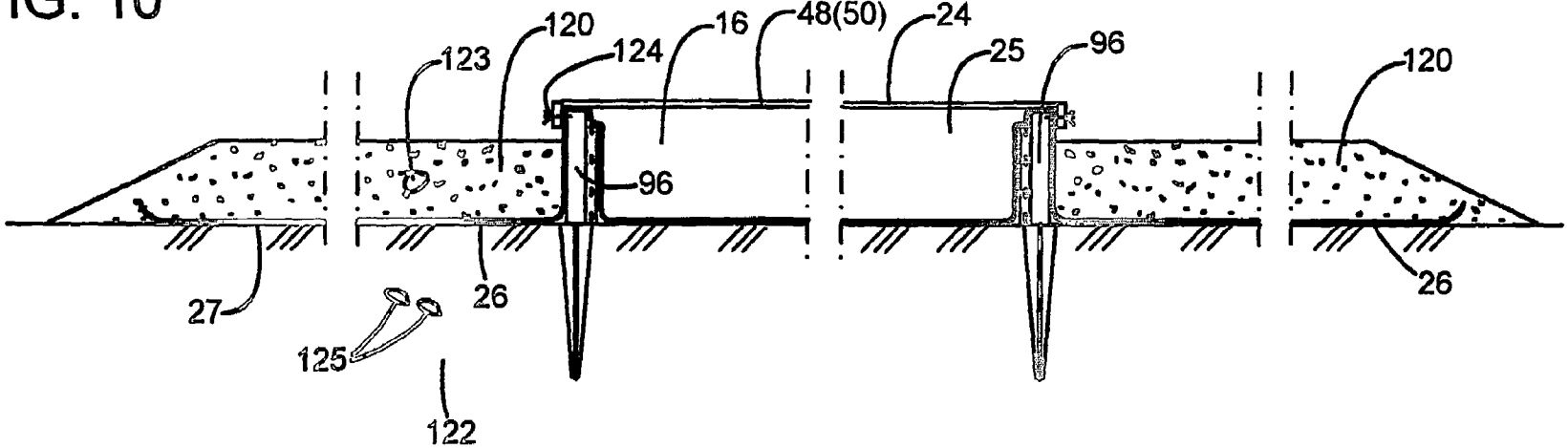
FIG. 10 is a detailed cross-sectional view of an alternative embodiment of the shooting apparatus of the present invention.

As best shown in FIG. 10, a detailed cross-sectional view along line 10—10 in FIG. 1 is shown. The apparatus 10 may have an extended watertight bottom layer 27 of the layer 26 that extends on both sides of the container 25 having the top layer 24 so that further contamination of the ground segment 122 is prevented or reduced. The region 120 may include sand, rocks or any other suitable filling material.

The extended layer 27 prevents the leaching of lead and other contaminants in the previously contaminated ground segment 122. In other words, the extended layer 27 prevents water 123 in the region 120 from entering into the ground segment 122 that can create further contamination of the lead bullets 125 that may already exist in the ground segment 122. Another function of the layer 27 is to prevent the leaching of lead from the region 120 into the ground segment 122.

Figure 11:
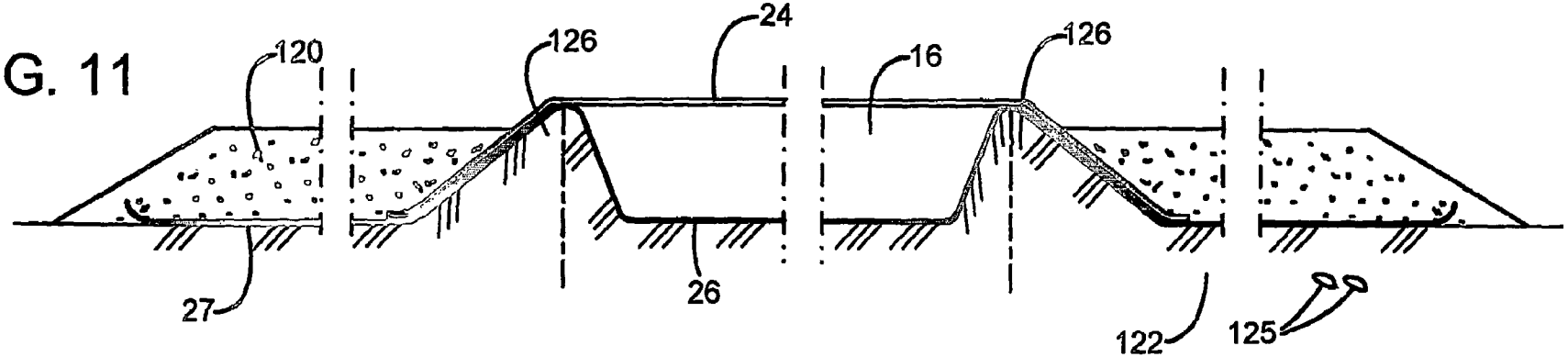
FIG. 11 is a detailed cross-sectional view of an alternative embodiment of the shooting apparatus of the present invention.

The bottom layer 26 may be attached to the support members 96 by a suitable elongate member 124 so that the top layer 24 and the bottom layer 26 form a tight seal. FIG. 11 is substantially similar to the apparatus 10 in FIG. 10 except that the top layer 24 is supported by a sand- or rock rise 12E and the bottom layer 26 extends over and beyond the rise 126. The top layer 24 extends over and beyond the rise 126.

Figure 12:
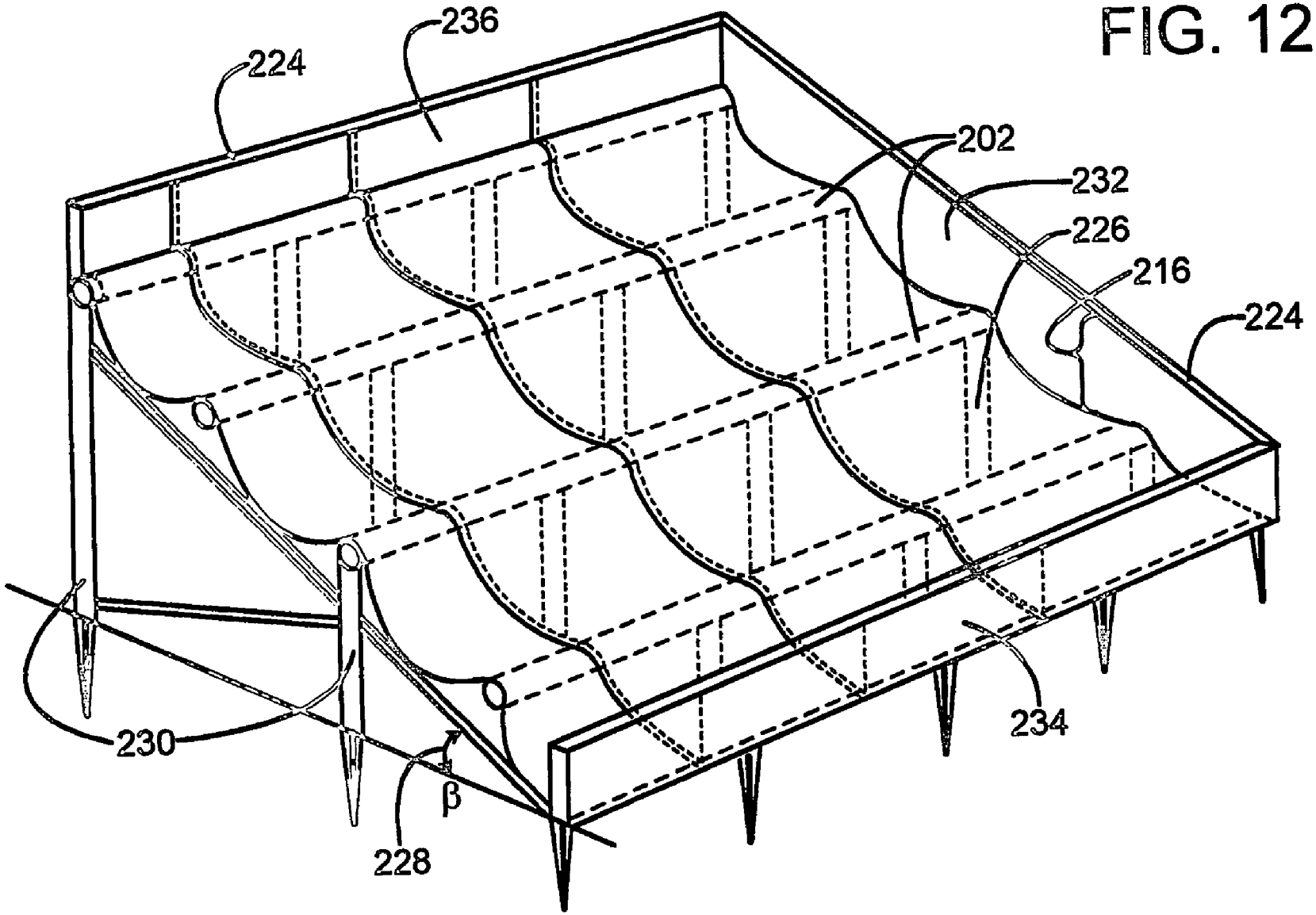
FIG. 12 is a perspective view of yet another alternative embodiment of the shooting range apparatus of the present invention.

FIG. 12 shows a shooting range apparatus 200 that has round horizontal support bars 202 for supporting a bottom layer 226 for supporting a granulated material 216 that is placed below a resilient top layer 224. The bottom layer 226 may form a wavy shape due to the weight of the granulated or rubber material 216 and the lack of support between the beams 202. Only a corner of the material 216 and the layer 224 are shown in FIG. 12 for clarity. The bottom layer 226 is supported of vertical poles 230 so that the layer 226 is disposed at an angle beta 228 that is less than the angle of repose of the material 216. The apparatus 200 may have vertical sidewalls 232, a front wall 234 and a back wall 236 to hold the material 216 therein.

Figure 13:
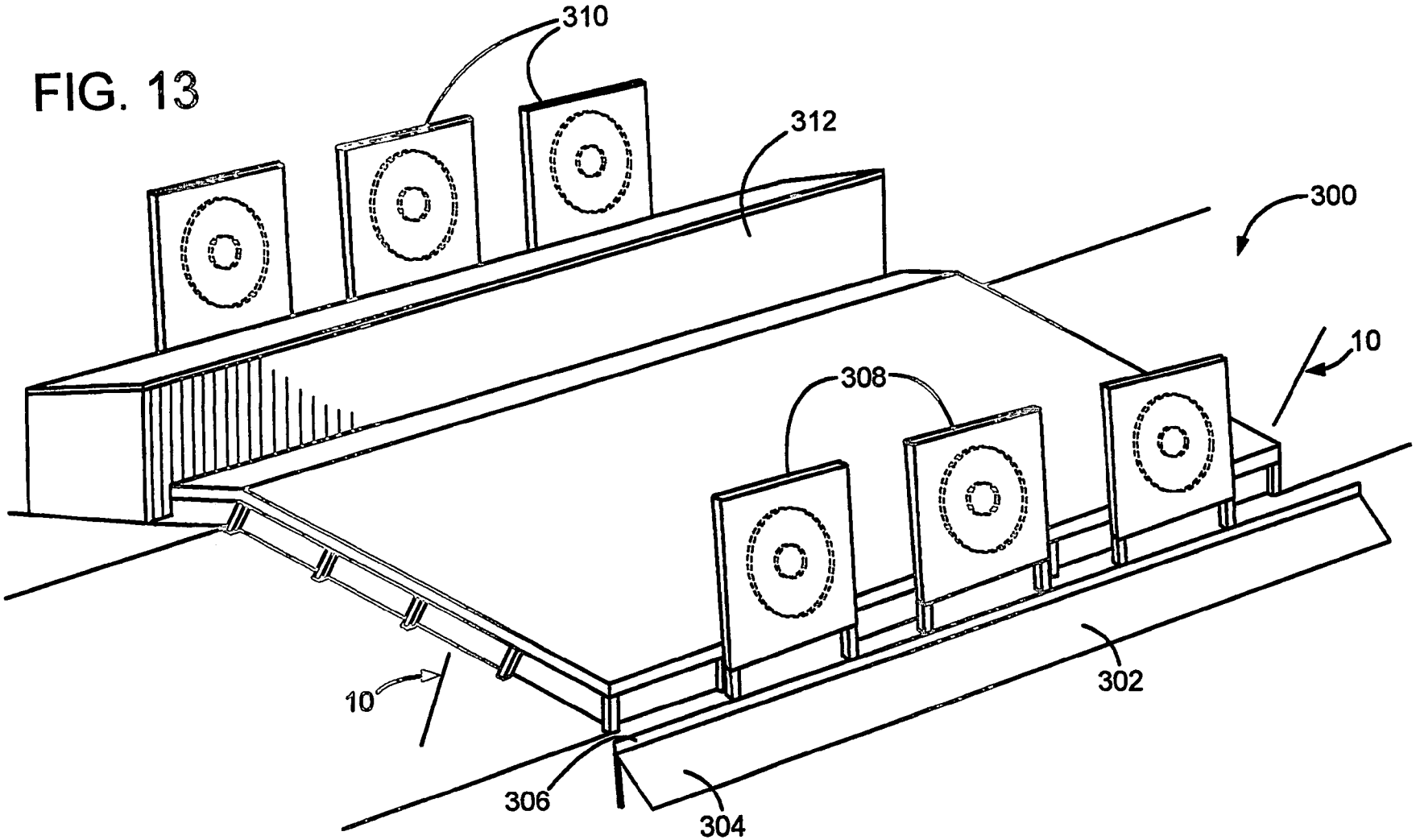
FIG. 13 is a perspective view of another embodiment of the shooting range of the present invention.

FIG. 13 shows an alternative embodiment 300 that is substantially similar to the apparatus 10 shown in FIG. 1. However, the apparatus 300 has a bullet diverting member 302 placed below the front wall. The member 302 has a sloping segment 304 and a vertical segment 306 so that when bullets hit the sloping segment 304 they are diverted towards the segment 306 and then away from the apparatus 300. The sloping and vertical segment may be protected against ricochets by a layer of a self-healing material mounted in distance from the segments. The apparatus 300 also has targets 308 shown at the member 302 and targets 310 on top of a rectangular housing 312. The segment 306 prevents the bullets from bouncing against the segment 304 and into the targets 308.

In general, the granulated stopping material preferably consists of particulate solids with suitable properties to stop incoming projectiles without creating lead-dust. Such materials can preferably be elastomeric materials designed into shapes of granules, powder or a gradation with both components or consisting of other materials with similar properties.

The granulated stopping material may be placed on a surface of high friction against the stopping-material and/or supplied with conformities over or under this surface to hold the granulated stopping material in place to prevent it from sliding down. This angle of slide may be kept smaller than the angle of repose of the stopping-material itself to prevent the material from moving downwardly at impact. The cover that covers the stopping material supports the stopping-material to stay in place through additional weight.

A supporting construction can be of any shape and made from any construction material that has enough capability to hold the weight of the box in the desired angle, and will become the same sliding angle as the bottom surface. In case of using a sand slope as the supporting construction, the angle of repose of the sand may be the limit of which suitable angle may be used since the angle of repose of sand is relatively low.

In case of using a separate bottom layer, the supporting construction does not have to be a uniform surface but can be made of supporting round beams spaced with partially open distances. The bottom layer may rest on the round beams as hanging carpets supporting the stopping material or resting or a rough surface like a natural dirt segment or an old range-segment of sand. Optionally, the bottom layer may be watertight but that is not necessary. In case of outdoor use, the bottom layer may also be sealed trough heat or chemical bonding or mechanically tightening together with the top layer. The top layer may be fastened to the supporting frame or held in place by shoveling dirt over the edges. The bottom layer that may be disposed outside the frame may be held in place by the material that can be shot at, and a layer that is heavy enough to hold it down without permitting projectiles passing the bottom layer.

The principle is to let the contaminated sand stay under the bottom layer under conditions that the bottom layer which in this case is watertight will stop further contamination as water will not enter and thus cannot leach out lead from the sand that is disposed underneath.

The bottom layer should be connected watertight at the highest level to a wall, or the layer should be enlarged to cover the area to the beginning of the slope at the backside for the surface water to stream freely on the backside or the layer to be connected to a drain trough an open ditch or via a drainpipe.

When using a sealed construction one of the benefits is that moisture, condensation and lead that may pollute the water is directed to enter the drainage system and be safely collected there without creating any environmental damage.

The box-type catcher with lid may be used with fire-protective agents in a floating form as this can be circulated through the drainage pipe and may be uniformly spread without external mixing. Because of oxygen having access to the space under the lid, it is important to have a fire protection when shooting with tracers. The same can be adapted to the sealed sloping version with drainage if extra protection is desired. The frames of recycled polyethylene plastic or rubber material are free from ricochets.

While the present invention has been described in accordance with preferred compositions and embodiments, it is to be understood that certain substitutions and alterations may be made thereto without departing from the spirit and scope of the following claims.

I claim:

1. An apparatus for installation at shooting ranges, comprising:

a housing having a resilient top layer and a flexible bottom layer, the bottom layer extending along an inclined bottom surface and over an upwardly protruding support member to a front side, the top layer being attached to the bottom layer at the front side to form a watertight container;

a stationary non-flowable material tightly packed in the container for adhering to projectiles that have penetrated through the top layer;

the inclined bottom surface being inclined at an angle relative to a horizontal plane, the angle being less than an angle of repose of the granulated material; and a supporting member being placed on top of the support member and the supporting member extending an entire width (W) of the housing, the housing having a dewatering means disposed therein.

2. An apparatus for installation at shooting ranges, comprising;

a housing having a resilient top layer and a flexible bottom layer, the bottom layer extending along an inclined bottom surface and over an upwardly protruding support member to a front side, the top layer being attached to the bottom layer at the front side to form a watertight container;

a stationary non-flowable material tightly packed in the container for adhering to projectiles that have penetrated through the top layer;

the inclined bottom surface being inclined at an angle relative to a horizontal plane, the angle being less than an angle of repose of the granulated material;

the housing being in operative engagement with a rectangular housing filled with a granulated material and having a resilient front layer for permitting projectiles to pass therethrough; and the housing having a horizontal segment disposed at an upper end of the housing and in front of the front layer, the segment and the front layer having a gap defined therebetween.

3. The apparatus according to claim 1 wherein the bottom layer and the top layer are attached to the supporting member.

4. The apparatus according to claim 2 wherein the housing has a watertight bottom layer extending upwardly on a portion of an inside of the front layer.

5. The apparatus according to claim 1 wherein the support member is substantially perpendicular to the bottom surface and the bottom layer.

6. The apparatus according to claim 2 wherein the housing has an L-shaped concrete wall for supporting a lid.

7. The apparatus according to claim 6 wherein the lid has a downwardly protruding protector.

8. The apparatus according to claim 1 wherein the apparatus has an inclined bullet diverter disposed below a set of targets.

9. The apparatus according to claim 1 wherein the housing has a horizontal segment (50) disposed at an upper end of the housing.

10. The apparatus according to claim 1 wherein the bottom layer is attached to the housing and has an area disposed outside the housing.

11. The apparatus according to claim 1 wherein the bottom layer extends in a direction to divert water therefrom.

* * * * *